US012173385B2

(12) United States Patent
Kai et al.

(10) Patent No.: US 12,173,385 B2
(45) Date of Patent: Dec. 24, 2024

(54) WELDABLE IN-SITU NANO-STRENGTHENED RARE-EARTH METAL CONTAINING ALUMINUM ALLOY WITH HIGH STRENGTH AND TOUGHNESS AND PREPARATION METHOD THEREOF

(71) Applicant: Jiangsu University, Jiangsu (CN)

(72) Inventors: Xizhou Kai, Jiangsu (CN); Yutao Zhao, Jiangsu (CN); Yanjie Peng, Jiangsu (CN); Gang Chen, Jiangsu (CN); Ruikun Chen, Jiangsu (CN); Lin Wu, Jiangsu (CN); Ran Tao, Jiangsu (CN); Xiangfeng Liang, Jiangsu (CN)

(73) Assignee: Jiangsu University, Jiangsu (CN)

( * ) Notice: Subject to any disclaimer, the term of this patent is extended or adjusted under 35 U.S.C. 154(b) by 0 days.

(21) Appl. No.: 18/287,187

(22) PCT Filed: Jun. 3, 2021

(86) PCT No.: PCT/CN2021/098105
§ 371 (c)(1),
(2) Date: Oct. 17, 2023

(87) PCT Pub. No.: WO2022/246889
PCT Pub. Date: Dec. 1, 2022

(65) Prior Publication Data

US 2024/0200166 A1 Jun. 20, 2024

(30) Foreign Application Priority Data

May 27, 2021 (CN) ..... 202110583558.7

(51) Int. Cl.
*C22C 1/10* (2023.01)
*B22D 11/00* (2006.01)
(Continued)

(52) U.S. Cl.
CPC ..... *C22C 1/1052* (2023.01); *B22D 11/003* (2013.01); *B22D 11/114* (2013.01);
(Continued)

(58) Field of Classification Search
None
See application file for complete search history.

(56) References Cited

U.S. PATENT DOCUMENTS

2009/0263277 A1 10/2009 Pandey

FOREIGN PATENT DOCUMENTS

CN 102021422 4/2011
CN 102021428 4/2011
(Continued)

OTHER PUBLICATIONS

"International Search Report (Form PCT/ISA/210) of PCT/CN2021/098105," mailed on Jan. 5, 2022, with English translation thereof, pp. 1-4.

(Continued)

*Primary Examiner* — George Wyszomierski
*Assistant Examiner* — Janell C Morillo
(74) *Attorney, Agent, or Firm* — JCIPRNET

(57) ABSTRACT

The present disclosure relates to an aluminum alloy material, and specifically to a weldable in-situ nano-strengthened rare-earth metal (REM)-containing aluminum alloy with high strength and toughness and a preparation method thereof. In the present disclosure, in-situ nano-ceramic particles and REMs simultaneously introduced into an Al—Zn—Mg alloy can effectively refine the grains and significantly improve the strength and toughness of the alloy; and REM-containing nano-precipitated phases and in-situ nanoparticles distributed in the grains or at grain boundaries can also significantly increase a recrystallization temperature of the alloy, effectively inhibit the dynamic recovery, reduce (Continued)

the re-dissolution of alloying elements, and improve the weldability of the alloy.

4 Claims, 1 Drawing Sheet

(51) Int. Cl.

| | |
|---|---|
| ***B22D 11/114*** | (2006.01) |
| ***C22C 21/00*** | (2006.01) |
| ***C22C 21/10*** | (2006.01) |
| ***C22F 1/00*** | (2006.01) |
| ***C22F 1/053*** | (2006.01) |

(52) U.S. Cl.
CPC ..... *C22C 21/003* (2013.01); *C22C 21/10* (2013.01); *C22F 1/002* (2013.01); *C22F 1/053* (2013.01)

(56) References Cited

FOREIGN PATENT DOCUMENTS

| | | |
|---|---|---|
| CN | 102168214 | 8/2011 |
| CN | 107739865 | 2/2018 |
| CN | 109234561 | 1/2019 |
| CN | 112281029 | 1/2021 |
| JP | 10849033 | 2/1996 |

OTHER PUBLICATIONS

"Office Action of China Counterpart Application", issued on Apr. 1, 2022, p. 1-p. 7.
"Office Action of China Counterpart Application", issued on Oct. 10, 2022, p. 1-p. 3.

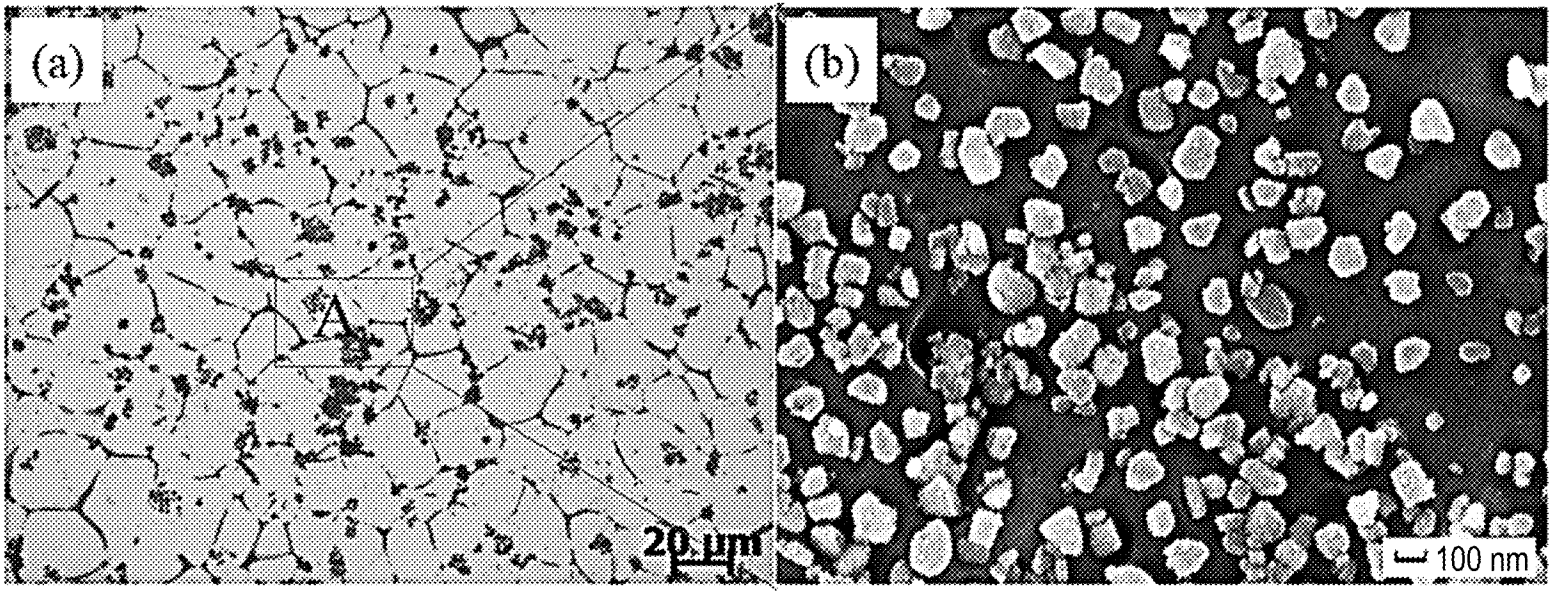
(a)
20 μm
(b)
100 nm

WELDABLE IN-SITU NANO-STRENGTHENED RARE-EARTH METAL CONTAINING ALUMINUM ALLOY WITH HIGH STRENGTH AND TOUGHNESS AND PREPARATION METHOD THEREOF

CROSS-REFERENCE TO RELATED APPLICATION

This application is a 371 application of International PCT application serial no. PCT/CN2021/098105 filed on Jun. 3, 2021, which claims the priority benefit of China application no. 202110583558.7 filed on May 27, 2021. The entirety of each of the above mentioned patent applications is hereby incorporated by reference herein and made a part of this specification.

TECHNICAL FIELD

The present disclosure relates to an aluminum alloy material, and specifically to a weldable in-situ nano-strengthened rare-earth metal (REM)-containing aluminum alloy with high strength and toughness and a preparation method thereof.

DESCRIPTION OF RELATED ART

Al—Zn—Mg aluminum alloys are medium-strength and high-strength aluminum alloys strengthenable by a heat treatment. These Al—Zn—Mg aluminum alloys have a high specific strength and excellent forming performance and weldability, and are widely used in fields such as aerospace, rail transit, and military equipment. In particular, important load-bearing components of high-speed trains are mostly made of Al—Zn—Mg aluminum alloys. However, the current improvement of a strength by alloying alone is close to a limit, leads to poor weldability, and cannot meet the increasingly-high requirements for properties of aluminum alloys. Therefore, a novel method for strengthening an aluminum alloy needs to be developed.

Currently, an aluminum alloy is strengthened by introducing a ceramic particle or adding an appropriate amount of REM. The patent "CN201811286812.1" discloses a preparation method of an in-situ dual-phase nanoparticle-strengthened aluminum matrix composite (AMC), where $ZrB_2$+$Al_2O_3$ particles are synthesized in-situ in an aluminum alloy through a direct melt reaction to produce the dual-phase nanoparticle-strengthened AMC. However, the agglomeration of nanoparticles themselves will affect properties of the composite, and this problem cannot be well solved by the introduction of dual-phase nanoparticles. The patent CN202011069290.7 discloses an aluminum alloy material and a preparation method thereof. In this preparation method, REMs Ce and Tb are introduced into an aluminum alloy to improve the mechanical performance, corrosion resistance, die-casting performance, weldability, wear resistance, and thermal conductivity of the aluminum alloy. However, when the REMs are added at excessive amounts, properties of the aluminum alloy material will be deteriorated; and when the REMs are added at small amounts, a limited strengthening effect can be allowed, and comprehensive properties of the aluminum alloy material need to be further improved.

Therefore, the development of a novel method for strengthening an aluminum alloy to effectively improve comprehensive properties of the aluminum alloy has a promising application prospect, and is of great significance for development of aluminum alloys and composites.

SUMMARY

An objective of the present disclosure is to provide a weldable in-situ nano-strengthened REM-containing aluminum alloy with high strength and toughness and a preparation method thereof in view of the shortcomings of the prior art. The aluminum alloy material exhibits improved toughness and significantly-enhanced weldability while retaining the characteristics of light weight and high strength, which effectively improves the drawbacks brought by a single strengthening method.

In the present disclosure, in-situ nano-ceramic particles and REMs simultaneously introduced into an Al—Zn—Mg alloy can effectively refine the grains and significantly improve the strength and toughness of the alloy; and REM-containing nano-precipitated phases and in-situ nanoparticles distributed in the grains or at grain boundaries can also significantly increase a recrystallization temperature of the alloy, effectively inhibit the dynamic recovery, reduce the re-dissolution of alloying elements, and improve the weldability of the alloy.

The present disclosure achieves the above objective through the following technical solutions.

A weldable in-situ nano-strengthened REM-containing aluminum alloy with high strength and toughness is provided. The weldable in-situ nano-strengthened REM-containing aluminum alloy is prepared through composition control, in-situ nano-ceramic particle strengthening and refinement, REM microalloying, acoustic magnetic field-controlled compounding, and ultrasonic semi-continuous casting based on an Al—Zn—Mg aluminum alloy as a matrix, and the weldable in-situ nano-strengthened REM-containing aluminum alloy includes nano-$Al_3$(Er+Zr), $Al_3$(Sc+Zr), and $Al_3Y$ REM-containing precipitated phases uniformly distributed in the grains and a large number of in-situ nano-$ZrB_2$, $Al_2O_3$, and $TiB_2$ ceramic particles distributed at the grain boundaries.

The weldable in-situ nano-strengthened REM-containing aluminum alloy with high strength and toughness includes the following chemical components in mass percentages: Zn: 5 to 7, Mg: 2 to 3, Mn: 0.7 to 0.8, Cr: 0.1 to 0.2, Cu: 0.2 to 0.3, Zr: 1.5 to 8, Ti: 1.5 to 8, B: 0.4 to 5, O: 0.2 to 2, Er: 0.05 to 0.3, Sc: 0.05 to 0.3, Y: 0.1 to 0.5, and Al: the balance.

A preparation method of the weldable in-situ nano-strengthened REM-containing aluminum alloy with high strength and toughness is provided, including the following steps:

(1) performing an in-situ reaction for in-situ generating nano-ceramic particles under a control of an acoustic magnetic field;

(2) after the in-situ reaction is completed, introducing metal elements and REMs;

(3) preparing an aluminum alloy ingot with uniform components, and a controllable distribution of the nano-ceramic particles in grains or at grain boundaries through the ultrasonic semi-continuous casting; and (4) finally, subjecting the aluminum alloy ingot to homogenization, forming, and a heat treatment to obtain the weldable in-situ nano-strengthened REM-containing aluminum alloy with high strength and toughness.

In the preparation method of the weldable in-situ nano-strengthened REM-containing aluminum alloy with high strength and toughness, the nano-ceramic particles are nano-$ZrB_2$, $Al_2O_3$, and $TiB_2$ ceramic particles generated through the in-situ reaction in a melt and have a particle size of 10 nm to 100 nm, and a volume fraction of 1% to 15% based on the weldable in-situ nano-strengthened REM-containing aluminum alloy with high strength and toughness.

In the preparation method of the weldable in-situ nano-strengthened REM-containing aluminum alloy with high strength and toughness, the REMs are Sc, Er, and Y.

In the preparation method of the weldable in-situ nano-strengthened REM-containing aluminum alloy with high strength and toughness, in the step (1), reactants for generating the nano-ceramic particles are two or more selected from the group consisting of $K_2ZrF_6$, $K_2TiF_6$, $KBF_4$, $Na_2B_4O_7$, $ZrO_2$, $B_2O_3$, and $Al_2(SO_4)_3$.

In the preparation method of the weldable in-situ nano-strengthened REM-containing aluminum alloy with high strength and toughness, in the step (1), the in-situ reaction is conducted at 850° C. to 900° C. for 20 min to 30 min.

In the preparation method of the weldable in-situ nano-strengthened REM-containing aluminum alloy with high strength and toughness, in the step (1), the control of the acoustic magnetic field is conducted under the following parameters: a pulse width range: 100 μs to 50 ms, a frequency range: 10 Hz to 15 Hz, and a pulse magnetic field peak intensity range: 1 T to 10 T.

In the preparation method of the weldable in-situ nano-strengthened REM-containing aluminum alloy with high strength and toughness, in the step (1), an ultrasonic treatment is conducted at an ultrasonic power of 5 kW to 10 kW for 10 min at an interval of 2 minutes.

In the preparation method of the weldable in-situ nano-strengthened REM-containing aluminum alloy with high strength and toughness, in the step (2), components are introduced as follows: after the in-situ reaction is completed, cooling to 750° C. to 760° C., adding pure Zn, pure Cu, Al—Cr, Al—Mn, Al—Zr, and REM-containing intermediate alloys, and conducting a reaction for 10 min to 15 min; after the reaction is completed, conducting slagging-off, refining, and degassing; and cooling to 680° C., adding pure Mg, and further conducting a reaction for 10 min to 15 min.

In the preparation method of the weldable in-situ nano-strengthened REM-containing aluminum alloy with high strength and toughness, in the step (3), the ultrasonic semi-continuous casting is conducted under the following conditions: an ultrasonic output frequency: (25±0.5) kHz, an ultrasonic output power: 200 W to 300 W, and an ultrasonic treatment mode: continuous ultrasound.

In the preparation method of the weldable in-situ nano-strengthened REM-containing aluminum alloy with high strength and toughness, in the step (4), the homogenization is conducted by a secondary homogenization process: 350° C. to 370° C./8 h to 10 h+450° C. to 470° C./10 h to 12 h.

In the preparation method of the weldable in-situ nano-strengthened REM-containing aluminum alloy with high strength and toughness, in the step (4), the forming is conducted by one or more selected from the group consisting of rolling, extrusion, and forging, annealing is conducted at 500° C. for 4 h before the forming, and the forming is conducted at 450° C. to 500° C. with a deformation amount of 50% to 500%.

In the preparation method of the weldable in-situ nano-strengthened REM-containing aluminum alloy with high strength and toughness, in the step (4), the heat treatment is conducted as follows: T6: 470° C. to 500° C./1 h to 2 h, water-cooling+150° C. to 160° C./30 min to 12 h.

A basis of the synergistic strengthening with nanoparticles and REMs in the present disclosure is as follows.

Strengthening nanoparticles are directly generated in-situ in an aluminum melt through a reaction, and have excellent binding performance for a matrix, high thermal stability, and a small size. Thus, the composite has relatively prominent strength and plastic toughness, and is widely used in the field of industrial manufacturing. However, the nanoparticle strengthening has disadvantages such as easy agglomeration of strengthening particles and uneasy control of a size and distribution of particles, which will lead to reduction of toughness of the composite. The introduction of REMs into an Al—Zn—Mg aluminum alloy can increase the recrystallization temperature, inhibit the recrystallization of the alloy, refine the grains, and promote the precipitation of a η' phase, thereby improving plasticity, fatigue performance, and stress corrosion sensitivity. However, when REMs are introduced at small amounts, only a limited strengthening effect is allowed for the Al—Zn—Mg aluminum alloy; and when REMs are introduced at excessive amounts, a grain size will be increased. Therefore, the synergistic strengthening of an aluminum alloy with in-situ nanoparticles and REMs can greatly improve the strength, toughness, and weldability of the aluminum alloy.

Compared with the prior art, the present disclosure has the following beneficial effects.

(1) In the present disclosure, a direct melt reaction method is used in combination with preparation of in-situ nano-ceramic particles under electromagnetic and ultrasonic control, and REMs are introduced to obtain nano-REM-containing precipitated phases uniformly distributed in the grains, which can refine the grains and inhibit the recrystallization. In addition. REMs can make strengthening nanoparticles uniformly distributed, which improves the wettability and bonding strength between a matrix and the strengthening nanoparticles, thereby greatly improving the strength and toughness of an aluminum alloy.

(2) The introduction of REMs improves the weldability of the aluminum alloy and further expands an application range of the aluminum alloy.

BRIEF DESCRIPTION OF THE DRAWINGS

The FIGURE shows a metallographic image of the weldable in-situ nano-strengthened REM-containing aluminum alloy with high strength and toughness and an enlarged view of a region in the metallographic image, where (a) is the metallographic image and (b) is the enlarged view of the region A. It can be seen from the FIGURE that the addition of REMs makes nanoparticles uniformly dispersed and distributed, which facilitates the improvement of properties of the alloy.

DESCRIPTION OF THE EMBODIMENTS

The present disclosure may be implemented according to the following examples, but is not limited to the following examples. Unless otherwise specified, the terms used in the present disclosure generally have the meanings commonly understood by those of ordinary skill in the art. It should be understood that these examples are intended only to illustrate the present disclosure and do not limit the scope of the present disclosure in any way. In the following examples, various processes and methods not described in detail are conventional methods known in the art.

The present disclosure is further described below.

Example 1

An REM-containing aluminum alloy was formed, including the following chemical components in mass percentages:

Zn: 6.02, Mg: 2.59, Mn: 0.76, Cr: 0.11, Cu: 0.23, Zr: 1.80, Ti: 1.82, B: 0.80, O: 0.20, Er: 0.10, Sc: 0.12, Y: 0.10, and Al: the balance.

Specified amounts of $K_2ZrF_6$, $K_2TiF_6$, $KBF_4$, and $Na_2B_4O_7$ were weighed, dehydrated at 200° C. for 3 h, mixed, and thoroughly ground to obtain a ground reactant powder; pure aluminum was placed in a crucible and heated and melted by an induction coil, a temperature of a resulting aluminum melt was kept at 850° C., and the ground reactant powder was wrapped with an aluminum foil and pressed into the aluminum melt by a bell jar to allow a thorough reaction; an electromagnetic and ultrasonic control device was turned on with a pulse width of 500 μs, a frequency of 10 Hz, a pulse magnetic field peak intensity of 1 T, an ultrasonic power of 5 kW, and an ultrasonic time of 10 min at an interval of 2 minutes, and a reaction was conducted for 30 min; a resulting melt was cooled to 750° C., pure Cu, pure Zn, Al—Mn, Al—Cr, Al—Zr, Al—Sc, Al—Er, and Al—Y were added, and a reaction was conducted for 10 min; after the reaction was completed, slagging-off, refining, and degassing were conducted; a resulting melt was cooled to 680° C., pure Mg was added, and a reaction was further conducted for 10 min; ultrasonic semi-continuous casting was conducted with an output frequency of 25 kHz and an output power of 200 W to obtain an aluminum alloy ingot with uniform components, and a controllable distribution of the nano-ceramic particles in the grains or at the grain boundaries; the aluminum alloy ingot was homogenized under the following parameters: 350° C./8 h+450° C./10 h; and a homogenized aluminum alloy ingot was annealed at 500° C. for 4 h and then rolled at 450° C. with a final deformation amount of 90%. Before a tensile test, a sample was subjected to T6 heat treatment under the following parameters: 500° C./2 h, water-cooling+160° C./6 h. A welding test was conducted by laser welding under argon protection with a laser frequency of 8.5 Hz and a laser pulse width of 5 ms. Test results showed that the in-situ nano-strengthened REM-containing aluminum alloy had a tensile strength of 480 MPa, a yield strength of 412 MPa, and an elongation rate of 16.3%, which were improved by 30%, 28.5%, and 10% compared with the original alloy without nanoparticles and REMs, respectively. A laser weld of the in-situ nano-strengthened REM-containing aluminum alloy plate had a tensile strength of 415 MPa, a yield strength of 397 MPa, and an elongation rate of 14.7%, which were improved by 65%, 53%, and 30% compared with a laser weld of an unstrengthened alloy plate, indicating that the strengthened aluminum alloy plate had better comprehensive properties than the unstrengthened alloy plate.

Example 2

An REM-containing aluminum alloy was formed, including the following chemical components in mass percentages: Zn: 5.03, Mg: 2.06, Mn: 0.71, Cr: 0.13, Cu: 0.25, Zr: 2.30, Ti: 2.26, B: 1.90, O: 0.45, Er: 0.2, Sc: 0.2, Y: 0.21, and Al: the balance.

Specified amounts of $K_2ZrF_6$, $K_2TiF_6$, $KBF_4$, and $Na_2B_4O_7$ were weighed, dehydrated at 200° C. for 3 h, mixed, and thoroughly ground to obtain a ground reactant powder; pure aluminum was placed in a crucible and heated and melted by an induction coil, a temperature of a resulting aluminum melt was kept at 870° C., and the ground reactant powder was wrapped with an aluminum foil and pressed into the aluminum melt by a bell jar to allow a thorough reaction; an electromagnetic and ultrasonic control device was turned on with a pulse width of 1 ms, a frequency of 12 Hz, a pulse magnetic field peak intensity of 3 T, an ultrasonic power of 6 kW, and an ultrasonic time of 10 min at an interval of 2 minutes, and a reaction was conducted for 25 min; a resulting melt was cooled to 760° C., pure Cu, pure Zn, Al—Mn, Al—Cr, Al—Zr, Al—Sc, Al—Er, and Al—Y were added, and a reaction was conducted for 10 min; after the reaction was completed, slagging-off, refining, and degassing were conducted; a resulting melt was cooled to 680° C., pure Mg was added, and a reaction was further conducted for 10 min; ultrasonic semi-continuous casting was conducted with an output frequency of 25 kHz and an output power of 250 W to obtain an aluminum alloy ingot with uniform components, and a controllable distribution of the nano-ceramic particles in the grains or at the grain boundaries; the aluminum alloy ingot was homogenized under the following parameters: 360° C./9 h+460° C./11 h; and a homogenized aluminum alloy ingot was annealed at 500° C. for 4 h and then hot-extruded with an extrusion die temperature of 470° C. and a final deformation amount of 70%. Before a tensile test, a sample was subjected to T6 heat treatment under the following parameters: 480° C./2 h, water-cooling+160° C./10 h. A welding test was conducted by metal inert gas (MIG) welding under argon protection with a welding voltage of 25 V and a welding current of 200 A. Test results showed that the in-situ nano-strengthened REM-containing aluminum alloy had a tensile strength of 470 MPa, a yield strength of 406 MPa, and an elongation rate of 15.8%, which were improved by 27.3%, 26.6%, and 9% compared with the original alloy without nanoparticles and REMs, respectively. An MIG weld of the in-situ nano-strengthened REM-containing aluminum alloy plate had a tensile strength of 410 MPa, a yield strength of 390 MPa, and an elongation rate of 14.1%, which were improved by 63%, 50.3%, and 24.7% compared with an MIG weld of an unstrengthened alloy plate, indicating that the strengthened aluminum alloy plate had better comprehensive properties than the unstrengthened alloy plate.

Example 3

An REM-containing aluminum alloy was formed, including the following alloying components in mass percentages: Zn: 6.99, Mg: 2.98, Mn: 0.74, Cr: 0.15, Cu: 0.28, Zr: 3.11, Ti: 3.23, B: 2.45, O: 0.53, Er: 0.3, Sc: 0.3, Y: 0.3, and Al: the balance.

Specified amounts of $K_2ZrF_6$, $K_2TiF_6$, $KBF_4$, and $Na_2B_4O_7$ were weighed, dehydrated at 200° C. for 3 h, mixed, and thoroughly ground to obtain a ground reactant powder; pure aluminum was placed in a crucible and heated and melted by an induction coil, a temperature of a resulting aluminum melt was kept at 890° C., and the ground reactant powder was wrapped with an aluminum foil and pressed into the aluminum melt by a bell jar to allow a thorough reaction; an electromagnetic and ultrasonic control device was turned on with a pulse width of 5 ms, a frequency of 15 Hz, a pulse magnetic field peak intensity of 5 T, an ultrasonic power of 10 kW, and an ultrasonic time of 10 min at an interval of 2 minutes, and a reaction was conducted for 20 min; a resulting melt was cooled to 770° C., pure Cu, pure Zn, Al—Mn, Al—Cr, Al—Zr, Al—Sc, Al—Er, and Al—Y were added, and a reaction was conducted for 10 min; after the reaction was completed, slagging-off, refining, and degassing were conducted; a resulting melt was cooled to 680° C., pure Mg was added, and a reaction was further conducted for 10 min; ultrasonic semi-continuous casting was conducted with an output frequency of 25 kHz and an output power of 300 W to obtain an aluminum alloy ingot with uniform components, and a controllable distribution of the nano-ceramic particles in the grains or at the grain boundaries; the aluminum alloy ingot was homogenized under the following parameters: 370° C./10 h+470° C./12 h; a homogenized aluminum alloy ingot was annealed at 50020 C. for 4 h and then rolled at 500° C. with a final deformation amount of 80%. Before a tensile test, a sample was subjected to T6 heat treatment under the following parameters: 480° C./2 h, water-cooling+160° C./10 h. A welding test was conducted by friction stir welding (FSW), where a shaft shoulder of a mixing head had a diameter of 10 mm, a rotational speed was 1,500 r/min, and a welding speed was 500 mm/min. Test results showed that the in-situ nano-strengthened REM-containing aluminum alloy had a tensile strength of 473 MPa, a yield strength of 410 MPa, and an elongation rate of 16.1%, which were improved by 28.1%, 27.9%, and 8.7% compared with the original alloy without nanoparticles and REMs, respectively. An FSW weld of the in-situ nano-strengthened REM-containing aluminum alloy plate had a tensile strength of 409 MPa, a yield strength of 388 MPa, and an elongation rate of 14%, which were improved by 62.6%, 49.5%, and 23.9% compared with an FSW weld of an unstrengthened alloy plate, indicating that the strengthened aluminum alloy plate had better comprehensive properties than the unstrengthened alloy plate.

What is claimed is:

1. A preparation method of a weldable in-situ nano-strengthened rare-earth metal-containing aluminum alloy, the weldable in-situ nano-strengthened rare-earth metal-containing aluminum alloy comprising the following chemical components in mass percentages: Zn: 5 to 7, Mg: 2 to 3, Mn: 0.7 to 0.8, Cr: 0.1 to 0.2, Cu: 0.2 to 0.3, Zr: 1.5 to 8, Ti: 1.5 to 8, B: 0.4 to 5, O: 0.2 to 2, Er: 0.05 to 0.3, Sc: 0.05 to 0.3, Y: 0.1 to 0.5, and Al: the balance, wherein the weldable in-situ nano-strengthened rare-earth metal-containing aluminum alloy is prepared through composition control, in-situ nano-ceramic particle strengthening and refinement, rare-earth metal microalloying, acoustic magnetic field-controlled compounding, and ultrasonic semi-continuous casting based on an Al—Zn—Mg aluminum alloy as a matrix, to obtain the weldable in-situ nano-strengthened rare-earth metal-containing aluminum alloy comprising nano-$Al_3$(Er+Zr) rare-earth metal-containing precipitated phase, nano-$Al_3$(Sc+Zr) rare-earth metal-containing precipitated phase, and nano-$Al_3Y$ rare-earth metal-containing precipitated phase uniformly distributed in grains and a large number of in-situ nano-$ZrB_2$ ceramic particles, in-situ nano-$Al_2O_3$ ceramic particles, and in-situ nano-$TiB_2$ ceramic particles distributed at grain boundaries; and the preparation method comprises the following specific steps:

(1) performing an in-situ reaction for in-situ generating the nano-ceramic particles under a control of an acoustic magnetic field;

(2) after the in-situ reaction is completed, introducing metal elements and rare-earth metals as follows: after the in-situ reaction is completed, cooling to 750° C. to 760° C., adding pure Zn, pure Cu, Al—Cr, Al—Mn, Al—Zr, and rare-earth metal-containing intermediate alloys, and conducting a reaction for 10 min to 15 min; after the reaction is completed, conducting slagging-off, refining, and degassing; and cooling to 680° C., adding pure Mg, and further conducting a reaction for 10 min to 15 min, wherein the rare-earth metals are Sc, Er, and Y;

(3) preparing an aluminum alloy ingot with uniform components, and a controllable distribution of the nano-ceramic particles in the grains or at the grain boundaries through the ultrasonic semi-continuous casting; and (4) finally, subjecting the aluminum alloy ingot to homogenization, forming, and a heat treatment to obtain the weldable in-situ nano-strengthened rare-earth metal-containing aluminum alloy.

2. The preparation method of the weldable in-situ nano-strengthened rare-earth metal-containing aluminum alloy according to claim 1, wherein in the step (1), reactants for generating the nano-ceramic particles are two or more selected from the group consisting of $K_2ZrF_6$, $K_2TiF_6$, $KBF_4$, $Na_2B_4O_7$, $ZrO_2$, $B_2O_3$, and $Al_2(SO_4)_3$; the nano-ceramic particles are nano-$ZrB_2$ ceramic particles, nano-$Al_2O_3$ ceramic particles, and nano-$TiB_2$ ceramic particles generated through the in-situ reaction in a melt and have a particle size of 10 nm to 100 nm, and a volume fraction of 1% to 15% based on the weldable in-situ nano-strengthened rare-earth metal-containing aluminum alloy; and the control of the acoustic magnetic field is conducted under the following parameters: a pulse width range: 100 μs to 50 ms, a frequency range: 10 Hz to 15 Hz, a pulse magnetic field peak intensity range: 1 T to 10 T, an ultrasonic power: 5 kW to 10 kW, an ultrasonic time: 10 min, and an ultrasonic interval: 2 minutes.

3. The preparation method of the weldable in-situ nano-strengthened rare-earth metal-containing aluminum alloy according to claim 1, wherein in the step (3), the ultrasonic semi-continuous casting is conducted under the following conditions: an ultrasonic output frequency: 25±0.5 kHz, an ultrasonic output power: 200 W to 300 W, and an ultrasonic treatment mode: continuous ultrasound.

4. The preparation method of the weldable in-situ nano-strengthened rare-earth metal-containing aluminum alloy according to claim 1, wherein in the step (4), the homogenization is conducted by a secondary homogenization process: 350° C. to 370° C./8 h to 10 h+450° C. to 470° C./10 h to 12 h; the forming is conducted by one or more selected from the group consisting of rolling, extrusion, and forging, annealing is conducted at 500° C. for 4 h before the forming, and the forming is conducted at 450° C. to 500° C. with a deformation amount of 50% to 500%; and the heat treatment is conducted as follows: T6: 470° C. to 500° C./1 h to 2 h, water-cooling+150° C. to 160° C./30 min to 12 h.

* * * * *